US011154153B2

(12) United States Patent
McNabb et al.

(10) Patent No.: US 11,154,153 B2
(45) Date of Patent: Oct. 26, 2021

(54) HANGABLE APPARATUS AND SYSTEMS AND METHODS THEREFOR

(71) Applicant: Medline Industries, Inc, Northfield, IL (US)

(72) Inventors: Steve McNabb, Kenosha, WI (US); Che Rocco Mirabile, Titusville, FL (US); John Piazzi, Chicago, IL (US); Michael Turturro, Arlington Heights, IL (US); Paige Wexler, Highland Park, IL (US)

(73) Assignee: Medline Industries, Inc., Northfield, IL (US)

( * ) Notice: Subject to any disclaimer, the term of this patent is extended or adjusted under 35 U.S.C. 154(b) by 0 days.

(21) Appl. No.: 17/066,123

(22) Filed: Oct. 8, 2020

(65) Prior Publication Data

US 2021/0030188 A1 Feb. 4, 2021

Related U.S. Application Data

(62) Division of application No. 16/045,391, filed on Jul. 25, 2018, now Pat. No. 10,799,055.

(51) Int. Cl.

| | |
|---|---|
| ***A47H 1/14*** | (2006.01) |
| ***A47H 1/142*** | (2006.01) |
| ***A47H 1/144*** | (2006.01) |
| ***A47H 1/104*** | (2006.01) |
| ***A47H 1/102*** | (2006.01) |
| *A47H 1/04* | (2006.01) |

(52) U.S. Cl.

CPC ..... *A47H 1/14* (2013.01); *A47H 1/102* (2013.01); *A47H 1/104* (2013.01); *A47H 1/142* (2013.01); *A47H 1/144* (2013.01); *A47H 1/04* (2013.01)

(58) Field of Classification Search

CPC ..... A47H 1/102; A47H 1/104; A47H 1/14; A47H 1/142; A47H 1/144; F16B 2/06; F16B 2/065; F16B 2200/403; F16B 2200/406

USPC ..... 16/87.2, 94 R, 94 D

See application file for complete search history.

(56) References Cited

U.S. PATENT DOCUMENTS

| | | | | |
|---|---|---|---|---|
| 2,979,760 A * | 4/1961 | Sladky | F16B 2/065 220/776 |
| 3,192,994 A * | 7/1965 | Graber | A47H 5/03 160/345 |
| 3,688,717 A * | 9/1972 | Rudolph | B21C 37/28 72/356 |
| 3,881,218 A | 5/1975 | Palmer | |
| 3,989,283 A * | 11/1976 | Pepper | F16L 33/006 285/323 |
| 4,031,943 A | 6/1977 | Silvestre | |
| 4,190,927 A | 3/1980 | Hepperle | |

(Continued)

OTHER PUBLICATIONS

O'Brien, Jeffrey ,"Notice of Allowance", U.S. Appl. No. 16/045,391, filed Jul. 25, 2018; dated May 28, 2020.

*Primary Examiner* — Jeffrey O'Brien

(74) *Attorney, Agent, or Firm* — Philip H. Burrus, IV

(57) ABSTRACT

A track hanger (100) includes a hook (103) and an extension (104), a base member (1160), and a key (403). The key is detachable from the hook, and the base member is detachable from the extension. The key can include a first major surface (401) and a second major surface (402). The first major surface can define one or more barbs (404) that facilitate one-way insertion of the key into a track (106).

15 Claims, 14 Drawing Sheets

(56) References Cited

U.S. PATENT DOCUMENTS 4,228,738 A * 10/1980 Forshee ..... B61B 12/02 104/95
4,228,980 A * 10/1980 Beauchamp ..... A47H 1/18 16/87.2
4,229,857 A 10/1980 Toder
5,186,232 A 2/1993 Zahner
5,335,890 A * 8/1994 Pryor ..... A47H 1/04 16/94 D
5,598,785 A * 2/1997 Zaguroli, Jr. ..... B66C 7/04 104/111
6,189,597 B1 2/2001 Cheng
6,223,389 B1 5/2001 Walsh et al.
6,382,297 B1 5/2002 Takizawa
6,494,248 B1 12/2002 Zahner
6,866,082 B1 3/2005 Zahner
6,935,402 B2 8/2005 Zahner
7,003,848 B2 * 2/2006 Ho ..... A47H 13/04 16/87.2
D551,950 S 10/2007 Davenpor
7,296,609 B2 11/2007 Zahner
7,523,778 B2 4/2009 Roberts et al.
8,118,078 B2 * 2/2012 Freedland ..... A47H 1/02 160/330
8,151,385 B2 4/2012 Goskowski et al.
8,235,088 B2 8/2012 Zahner
D668,091 S 10/2012 Zahner
D669,721 S 10/2012 Zahner
8,307,499 B2 * 11/2012 Ruffo ..... A47H 15/02 16/87.2
8,408,275 B2 * 4/2013 DeWees ..... A47H 13/02 160/330
8,719,974 B2 5/2014 Empey
9,022,333 B2 * 5/2015 Chen ..... F16B 5/0621 248/228.4
D746,078 S 12/2015 Zahner
9,861,222 B2 * 1/2018 Bauer ..... A47H 1/142
10,045,649 B2 8/2018 Zahner
10,085,582 B2 * 10/2018 Zahner ..... A47H 1/144
10,264,908 B2 * 4/2019 Hatton ..... A47H 15/02
2,652,586 A1 1/2020 Ramsberger
10,758,072 B2 * 9/2020 Hatton ..... A47H 13/04
2002/0074094 A1 * 6/2002 Griggs ..... A47H 13/00 160/330
2003/0012924 A1 1/2003 Samelson
2005/0022950 A1 2/2005 Putman
2006/0037721 A1 2/2006 Zahner
2006/0266483 A1 11/2006 Roberts et al.
2008/0164393 A1 7/2008 Hung
2008/0178423 A1 7/2008 Patel
2008/0202710 A1 8/2008 Zahner
2009/0032659 A1 * 2/2009 Goldstein ..... A47H 1/122 248/220.21
2009/0288783 A1 11/2009 Graneto, III
2009/0288784 A1 11/2009 Graneto, III
2009/0288785 A1 11/2009 Graneto, III
2010/0212845 A1 8/2010 Graneto, III et al.
2010/0282420 A1 11/2010 Lai
2010/0319858 A1 12/2010 Freedland
2010/0325836 A1 12/2010 Lai
2011/0000051 A1 * 1/2011 Liang ..... A47K 3/38 16/94 R
2011/0225774 A1 9/2011 Seddon
2011/0297632 A1 * 12/2011 Goldstein ..... A47H 1/142 211/105.6
2012/0000616 A1 * 1/2012 DeWees ..... A47H 1/08 160/330
2012/0018106 A1 1/2012 Robledo
2013/0019395 A1 1/2013 Pierce
2013/0025341 A1 * 1/2013 Ciprich ..... F16L 19/10 72/352
2013/0145543 A1 6/2013 Cittadino et al.
2014/0000821 A1 * 1/2014 DeWees ..... A47H 1/144 160/330
2015/0007950 A1 1/2015 Ho
2015/0068688 A1 3/2015 Zahner
2015/0136339 A1 * 5/2015 Bauer ..... A47H 1/142 160/330
2015/0173549 A1 * 6/2015 Zahner ..... A47H 13/02 160/330
2016/0367060 A1 * 12/2016 Zahner ..... A47H 1/144
2017/0314607 A1 * 11/2017 Bauer ..... A47H 1/142
2018/0177321 A1 6/2018 Heidsiek

* cited by examiner

HANGABLE APPARATUS AND SYSTEMS AND METHODS THEREFOR

CROSS REFERENCE TO PRIOR APPLICATIONS

This application is a divisional application claiming priority and benefit under 35 U.S.C. § 121 from U.S. application Ser. No. 16/045,391, filed Jul. 25, 2018, which is incorporated by reference for all purposes.

BACKGROUND

Technical Field

This disclosure relates generally to hangable devices, and more particularly to an items comprising a hanger that hangs from a rail or track.

Background Art

Hanging items are popular in homes and businesses. Hanging items include curtains, drapes, plants, art, and so forth. Hanging items typically include a hanger, a mount, and something suspended from the hanger. Using a plant as one example, the hanger may comprise a metal hook, with the plant suspended beneath the hook. A user may couple the hook to a loop, perhaps mounted on the ceiling, to hang the plant.

While there are a variety of types of hangers and types of hanging items, curtains provide special challenges for designers. This is especially true in medical or hospital environments. It is frequently the case that medical service providers employ curtains to separate patients, conceal medical procedures from view, and to segregate areas of operating rooms and care centers. It is advantageous to launder such curtains to prevent the curtains from acting as a vector to transfer pathogens and bacteria from one patient to the next. However, prior art curtains are difficult to remove from their mounting rods. The dismounting process is costly and labor intensive.

It would be advantageous to have an improved hangable apparatus, suitable for use in curtain and drape systems, which is easier and quieter to dismount.

Figure 1:
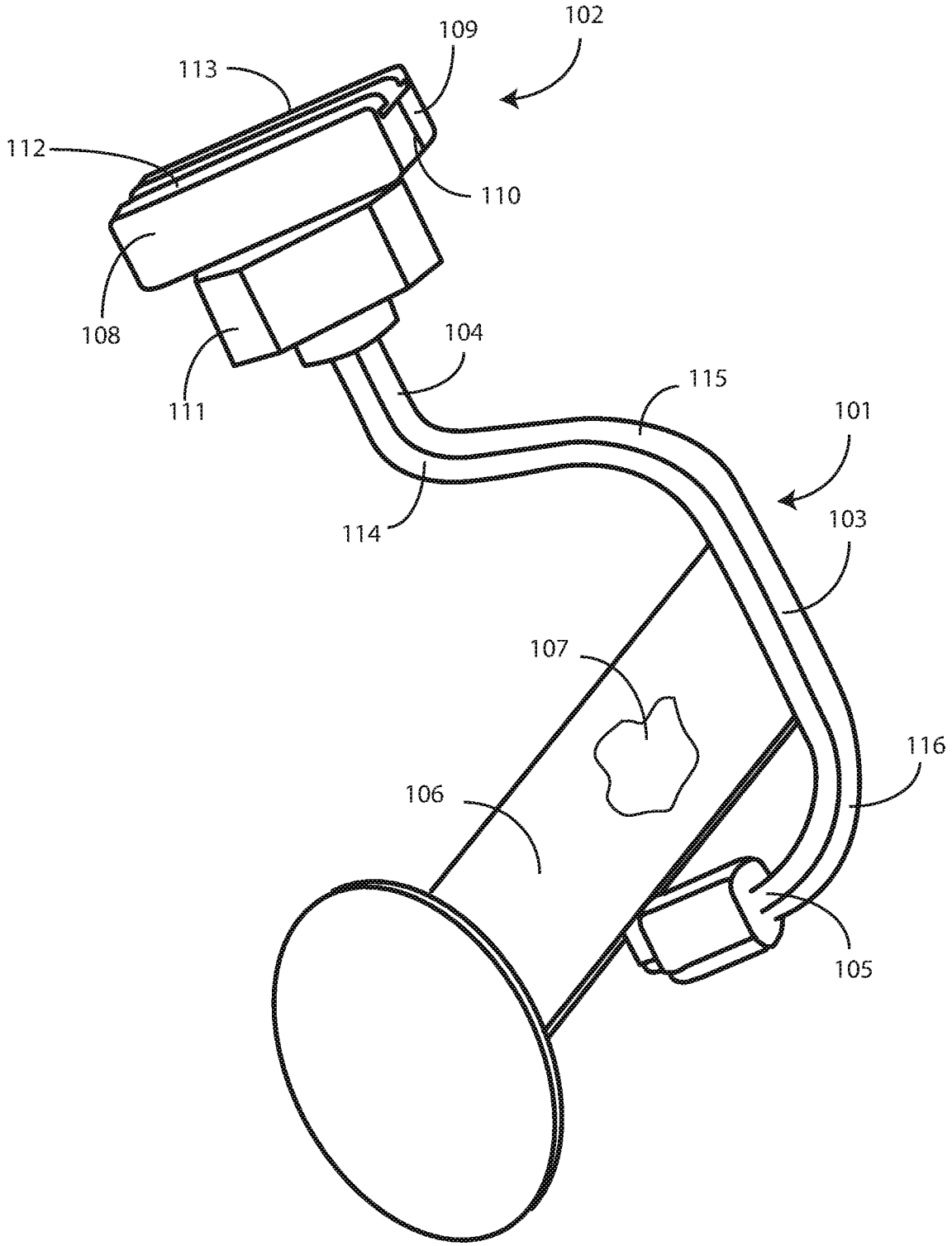
FIG. 1 illustrates a perspective view of one explanatory track hanger system in accordance with one or more embodiments of the disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION OF THE DRAWINGS

Embodiments of the disclosure are now described in detail. Referring to the drawings, like numbers indicate like parts throughout the views. Apparatus components and method steps have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions. The terms "substantially" and "about" are used to refer to dimensions, orientations, or alignments inclusive of manufacturing tolerances. Thus, a "substantially orthogonal" angle with a manufacturing tolerance of plus or minus two degrees would include all angles between 88 and 92, inclusive. Also, reference designators shown herein in parenthesis indicate components shown in a figure other than the one in discussion. For example, talking about a device (10) while discussing figure A would refer to an element, 10, shown in figure other than figure A.

Embodiments of the disclosure provide a track hanger for an item. In one embodiment, the item to be hung is a curtain. Illustrating by example, for a hospital setting where infection control is an area of high concern, track hangers configured in accordance with embodiments of the disclosure can be used to hang curtains between patients, procedures, areas, and so forth. Track hangers configured in accordance with embodiments of the disclosure are easier to mount and dismount, thereby making it easier for health care practitioners to change and launder the curtains to ensure that bacteria and other pathogens are not readily transferred from patient to patient or from patient to health care practitioner.

Embodiments of the disclosure contemplate that it is very difficult to change prior art curtain systems designed for health care environments. The hangers are difficult to dismount from their tracks. Additionally, dust can collect in upwardly open tracks, thereby causing the hangers to get stuck within those tracks. Multiple people with ladders and specialized equipment are required to dismount the curtains, making changing or laundering the curtains a labor-intensive and costly endeavor. Moreover, as most prior art medical curtains use metal hangers, the dismounting process is noisy and therefore aggravating to patients and medical practitioners. For this reason, curtains are rarely changed or washed. In some situations, it is considered fortunate if the curtains were changed three times a year.

Advantageously, embodiments of the disclosure offer an improved track hanger that is easier to mount and dismount from a tiled ceiling, i.e., a dropped ceiling that includes a suspension grid of metal channels or rails (referred to herein generally as "tracks"), which are suspended to support ceiling panels, as is found in most hospitals, doctor's offices, and other health care offices. In one or more embodiments, the track hanger includes a hook and an extension, a base member, and a key. Each component can be modular and detachable from the other. For example, the key can be detachable from the hook. Similarly, the base member can be detachable from the extension, and so forth. In one or more embodiments, the key includes a first major surface and a second major surface. One or both of the first major surface or the second major surface can define one or more barbs that facilitate a one-way insertion of the key into the track. This makes the track hangers and track extremely quick to mount.

Once mounted, curtains can be hung from the track. These curtains, such as those described in commonly assigned U.S. Ser. No. 15/651,774, filed Jul. 17, 2017, which is incorporated herein by reference, are quick and simple to mount and dismount. They require only a single person—working for a few minutes—to change the curtains. Accordingly, embodiments of the disclosure allow for more frequent changing and laundering of curtains, thereby promoting health and safety when used in hospitals or other health care settings.

In addition to potentially serving as vectors for bacteria and other pathogens, prior art curtain hanging systems have other problems as well. Most hangers require special mounting hardware and/or tools to mount to a wall or ceiling. Additionally, the mounting hardware leaves scars in the wall or ceiling should the hanger ever be taken down. Embodiments of the disclosure provide a solution to each of these problems by providing a base member that includes a first base member portion and a second base member portion. The first base member portion and the second base member portion are separable from each other along a medial major axis of the base member.

In one or more embodiments, the first base member portion comprises a first half rail clamp. Similarly, the second base member portion can include a second half rail clamp. Separating the first base member portion from the second base member portion along the medial major axis therefore separates the first half rail clamp from the second half rail clamp. When used with a drop ceiling having a suspension grid of tracks, one can simply place the first rail half clamp to the left of a track and the second rail half clamp to the right of the track, or vice versa. The first base member portion can then be pressed against the second base member portion along the medial major axis, which causes the track of the suspension grid to be caught between the first half rail clamp and the second half rail clamp. A fastener can then be attached to the base member to retain the first base member portion against the second base member portion so as to quickly and easily couple the base member to the rails of the suspension grid. In one or more embodiments, the coupler engages one or more threads disposed on the exterior surface of a head receiver extending distally from the base member to retain the first base member portion against the second base member portion. As will be shown in more detail below, the coupler can also be used to retain a head, which is attached to the extension and hook, within an interior socket supporting the threads. Thus, in one or more embodiments, a track hanger for an item comprises a uniquely configured base member that facilitates simple mounting and dismounting of the track hanger to a track of a conventional suspension grid of a drop ceiling.

Turning now to FIGS. 1-4, illustrated therein is one explanatory embodiment of a track hanger 100 configured in accordance with one or more embodiments of the disclosure. In one embodiment, the track hanger 100 is to suspend a track from a surface such as a wall or ceiling.

The track hanger 100, in one or more embodiments, includes a hanger 101, a base member 102, and a key 403. In one or more embodiments, each of the hanger 101, the base member 102, and the key 403 are separable from each other. For example, in one embodiment the hanger 101 can be detached from the base member 102. Similarly, the key 403 can be detached from the hanger 101. It should be noted that the track hanger 100 can be manufactured in different sizes and shapes so as to be compatible with, and fit appropriately, differently sized suspension grids of drop ceilings.

In one or more embodiments, the hanger 101 comprises a hook 103 and an extension 104. In one or more embodiments, the key 403 attaches to a distal end 105 of the hook 103. Accordingly, where the key 403 is detachable from the hanger 101, the attachment location to attach or detach the key 403 from the hook 103 is the distal end 105. Thus, in one or more embodiments the key 403 is detachable from the hook 103.

In one embodiment, the hanger 101 is configured as a single, unitary element. Said differently, in one embodiment the hook 103 and the extension 104 are manufactured as a single, integral unit. As will be described in more detail below with reference to FIG. 7, the hanger 101 can also include a head. Where included, the hook 103, the extension 104, and the head can be manufactured as a single, integral unit.

Illustrating by example, in one embodiment the hook 103, the extension 104, and the head are manufactured from a thermoplastic material by way of an injection molding process. The hook 103, the extension 104, and the head can be manufactured from nylon, styrene, ABS, polycarbonate, or polycarbonate-ABS, PMMA, PVC, or other polyamide-based thermoplastics in one embodiment. Other materials suitable for manufacturing the hook 103, the extension 104, and the head will be obvious to those of ordinary skill in the art having the benefit of this disclosure. While the base member 102 and the key 403 are separable from the hanger 101, in one or more embodiments the base member 102 and the key 403 can be manufactured from the same material as is the hanger 101. In other embodiments, the hanger 101 is manufactured from materials different from the base member 102 and/or key 403. The base member 102, hanger 101, and key 403 can each be manufactured from different materials as well.

Figure 4:
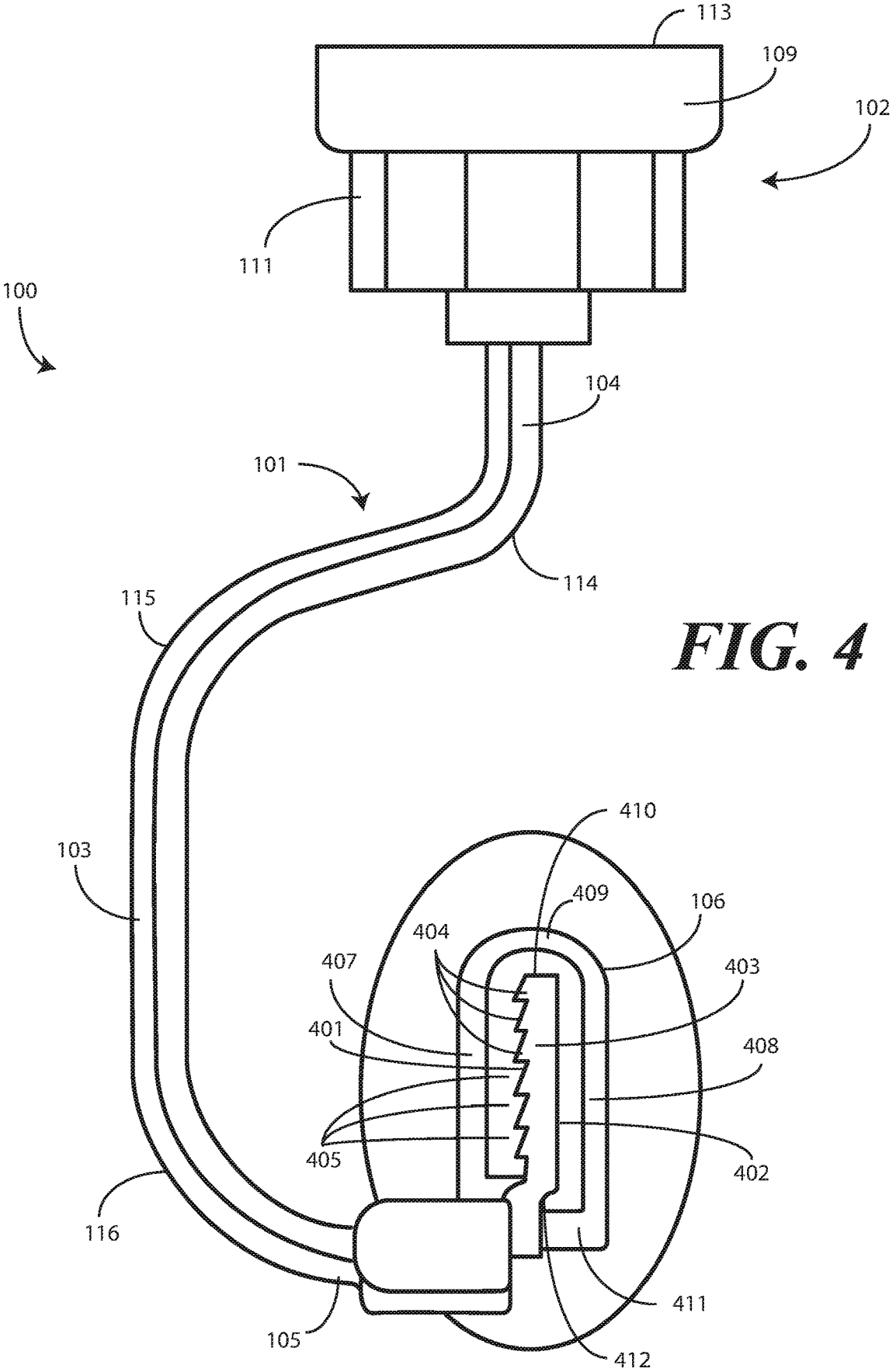
FIG. 4 illustrates a side elevation view of one explanatory track hanger in accordance with one or more embodiments of the disclosure.

As best seen in FIG. 4, in one embodiment the key 403 includes a first major surface 401 and a second major surface 402. In this illustrative embodiment, the first major surface 401 defines one or more barbs 404. Each barb comprises a hemi-triangular protrusion with the base of each hemi-triangular protrusion being disposed beneath the side of the hemi-triangular protrusion. In this illustrative embodiment, the second major surface 402 is substantially planar.

In one or more embodiments, a track 106 attaches to the key 403. In this illustrative embodiment, the track 106 has a first flat side 407 and a second flat side 408. An arch 409 spans between ends of the first flat side 407 and the second flat side 408 in this embodiment.

In one embodiment, the track 106 is flexible so that it can be shaped into different contours when attached to a track hanger 100. For example, in one embodiment the track 106 is manufactured from plastic. One suitable plastic for the track 106 is polyethylene, although other flexible materials will be obvious to those of ordinary skill in the art having the benefit of this disclosure. In one embodiment, the track 106 is manufactured from an extrusion process.

In one embodiment, the track 106 is a continuous piece. In other embodiments, segments of different tracks can be aligned end-to-end to form a composite track. In one embodiment, the track 106 is malleable. While the cross section of the track 106 shown in FIG. 4 is generally flat along each of the first flat side 407 and the second flat side 408, it should be noted that the cross section could take other shapes as well, such as ovular or flat.

In one embodiment the track 106 is configured so as to be easily cleanable. In one embodiment, the track 106 is manufactured so as to be light beige in color. In one embodiment, the track 106 is cut to predefined lengths, such as twenty-foot lengths. In one or more embodiments, the ends of the track 106 can be contoured for smooth interconnection to adjacent track segments.

In one embodiment, the track 106 comprises a coating 107. For example, in one embodiment the track 106 is coated with a silicon-based coating to allow curtains or other hangers to more smoothly slide along the track 106. It should be noted that one primary advantage offered by embodiments of the disclosure is that hanging systems configured in accordance with embodiments of the disclosure are very, very quiet when in operation. For example, where the track 106 is manufactured from polyethylene and coated with silicon, and a curtain having a hanger such as those described in commonly assigned U.S. Ser. No. 15/651,774, filed Jul. 17, 2017, which is incorporated herein by reference, which is made from a woven polyester mesh, moving the hanger along the track 106 is nearly a silent procedure. This is advantageous in hospitals and other medical environments where noise is problematic. Prior art hanging systems, which primarily include metal, are loud and intrusive. In one embodiment of the present disclosure, each of the track 106, the hanger, and any item attached thereto is made without any metal. This greatly reduces—if not eliminates—noise when the hangers are moved on the track 106.

A second advantage of not including metal in either the track 106 or items hanging therefrom is that components of systems configured in accordance with various embodiments of the disclosure can be extremely light in weight. This enables the track 106 to easily be mounted on the key 403. The process can be accomplished by anyone, regardless of size or strength.

The inclusion of the first flat side 407, the second flat side 408, and the arch 409 define a peninsular indentation 410 into which the key 403 may be inserted. In this illustrative embodiment, the track 106 comprises one or more complementary barbs 405. Each of the one or more complementary barbs 405 is complementary in shape to the one or more barbs 404 of the key 403. Here, each complementary barb comprises an inverted hemi-triangular protrusion with a base of each inverted hemi-triangular protrusion being disposed above a side of the inverted hemi-triangular protrusion.

Using this configuration, the one or more barbs 404 of the key 403 facilitate one-way penetration of the key 403 into the track 106. In one or more embodiments, the track 106 is manufactured from a pliable material, such as a thermoplastic. When the key 403 is inserted into the peninsular indentation 410, the first flat side 407 of the track 106 flexes so that the one or more complementary barbs 405 of the track 106 pass over the one or more barbs 404 of the key 403. Once the key 403 is fully inserted into the peninsular indentation 410 of the track 106, first flat side 407 of the track 106 flex back toward the key 403, thereby causing the one or more complementary barbs 405 to engage the one or more barbs 404 of the key 403. This results in the key 403 being frictionally retained within the track 106.

In one or more embodiments, the second flat side 408 of the track 106 terminates at an end opposite the arch 409 in an L-shaped latch 411. In one or more embodiments, the second major surface 402 of the key includes a complementary L-shaped indention 412 into which the base of the "L" of the L-shaped latch 411 seats when the key 403 is fully inserted into the track 106.

In operation, when the key 403 is inserted into the peninsular indentation 410, the second flat side 408 of the track 106 flexes so the base of the "L" of the L-shaped latch 411 of the track 106 can pass over the second flat side 408 of the key 403. Once the key 403 is fully inserted into the peninsular indentation 410 of the track 106, second flat side 408 of the track 106 flexes back toward the key 403, thereby causing the base of the "L" of the L-shaped latch 411 to seat within the complementary L-shaped indention 412 of the key 403. This assists in retaining the key 403 within the track 106.

In one or more embodiments, the base member 102 comprises a first base member portion 108 and a second base member portion 109. In one or more embodiments, the first base member portion 108 and the second base member portion 109 are separable along a medial major axis 110. In the illustrative embodiment of FIGS. 1-4, the first base member portion 108 and the second base member portion 109 have been placed together such that their inner surfaces abut along the medial major axis 110. A coupler 111, which in this embodiment is a plastic hex nut, couples the first base member portion 108 and the second base member portion 109 together to retain the inner surfaces abutting at the medial major axis 110.

Figure 2:
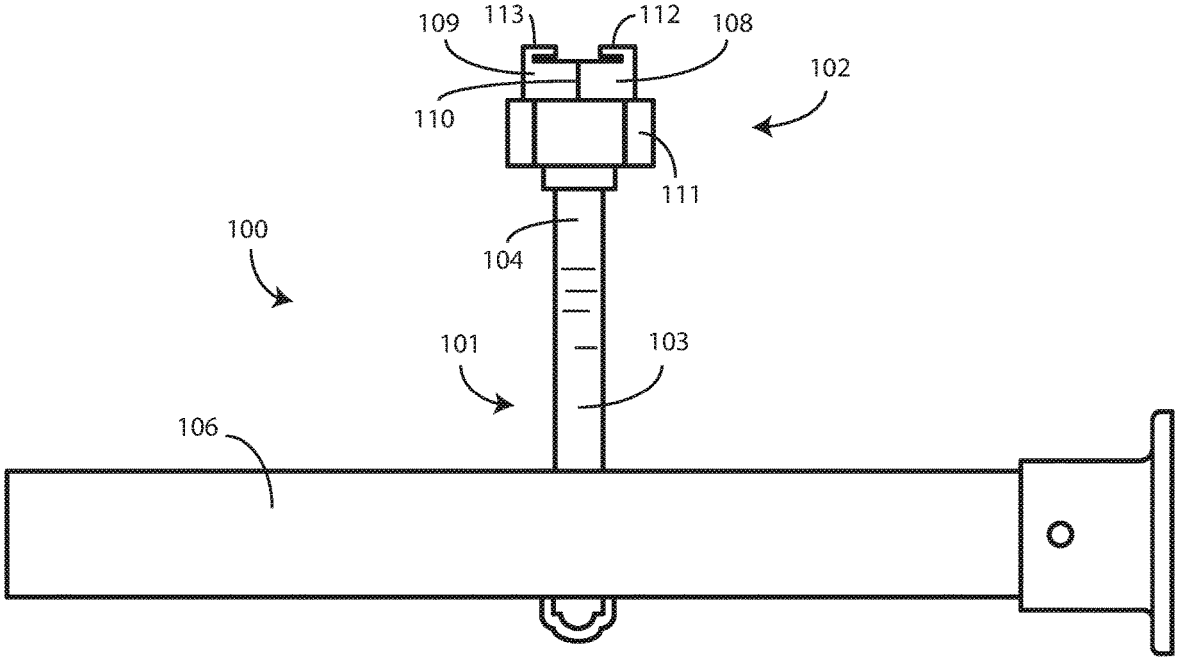
FIG. 2 illustrates a front elevation view of one explanatory track hanger system in accordance with one or more embodiments of the disclosure.
Figure 3:
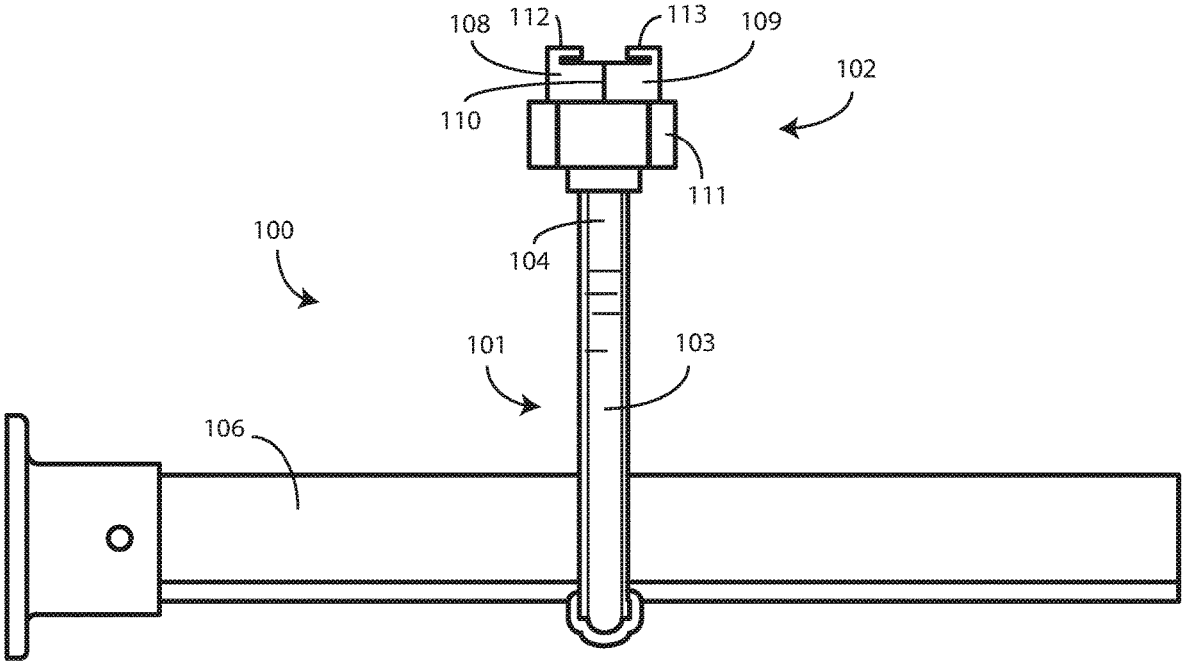
FIG. 3 illustrates a rear elevation view of one explanatory track hanger system in accordance with one or more embodiments of the disclosure.

In one or more embodiments, the first base member portion 108 defines a first half rail clamp 112. Similarly, the second base member portion 109 defines a second half rail clamp 113. Each of the first half rail clamp 112 and the second half rail clamp 113 includes a vertical member extending distally from the first base member portion 108 and the second base member portion 109, respectively, and a horizontal member extending distally from its respective vertical member only a portion of the width of the first base member portion 108 and the second base member portion 109. This leaves a gap between each horizontal member, as shown in FIGS. 2-3. Separating the first base member portion 108 from the second base member portion 109 along the medial major axis 110 therefore separates the first half rail clamp 112 from the second half rail clamp 113. When used with a drop ceiling having a suspension grid of tracks, one can simply place the first half rail clamp 112 to the left of a track and the second half rail clamp 113 to the right of the track, or vice versa. The first base member portion 108 can then be pressed against the second base member portion 109 along the medial major axis 110. This causes the track of the suspension grid to be caught between the first half rail clamp 112 and the second half rail clamp 113.

When the coupler 111 is then be attached to the base member 102 to retain the first base member portion 108 against the second base member portion 109, this causes the first half rail clamp 112 from the second half rail clamp 113 to couple the track hanger 100 to the rail of the suspension grid. In one or more embodiments, as will be described below with reference to FIGS. 6-9, the coupler 111 engages one or more threads disposed on the exterior surface of a head receiver extending distally from the base member 102 to retain the first base member portion 108 against the second base member portion 109. As will be also shown in more detail below in these figures, the coupler 111 can also be used to retain a head, which is attached to the extension 104 and hook 103, within an interior socket supporting the threads. Thus, in one or more embodiments, the track hanger 100 comprises a uniquely configured base member 102 that facilitates simple mounting and dismounting of the track hanger 100 to a track of a conventional suspension grid of a drop ceiling.

In the illustrative embodiment of FIGS. 1-4, hanger 101 of the track hanger 100 includes one or more bends 114, 115,116. In this illustrative embodiment, the hanger 101 includes three bends 114,115,116. Bend 114 and bend 115 are obtuse, while bend 116 is substantially orthogonal.

Figure 5:
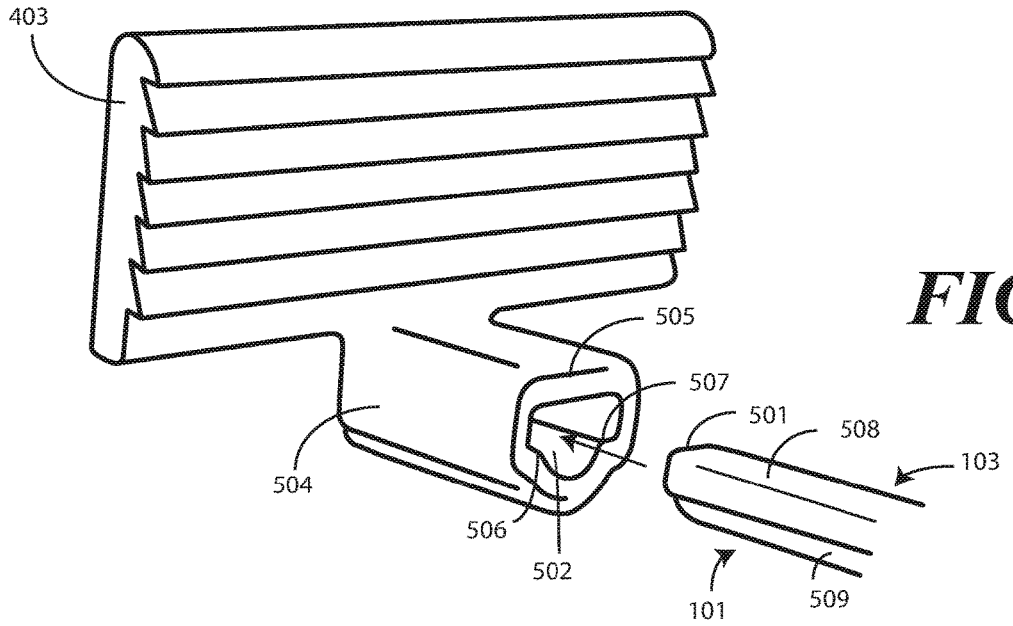
FIG. 5 illustrates one explanatory key and hook tip in accordance with one or more embodiments of the disclosure.

As noted above, in one or more embodiments each of the hanger 101, the base member 102, and the key 403 are separable from each other. For example, in one embodiment the hanger 101 can be detached from the base member 102. Similarly, the key 403 can be detached from the hanger 101. Turning now to FIG. 5, illustrated therein is the key 403 detached from the end 501 of the hook 103. In this illustrative embodiment, the key 403 is selectively attachable to the end 501 of the hook 103. To attach the key 403 to the end 501 of the hook 103, the end 501 of the hook 103 opposite the extension (104) of the hanger 101 is inserted into an aperture 502 defined within a connector 504 of the key. In one or more embodiments, the aperture 502 is configured to frictionally retain the key 403 to the end 501 of the hook 103. However, in other embodiments, a latch, snap, one-way latch, or other mating feature can be incorporated into either the aperture 502 or the end 501 of the hook 103 to frictionally retain the key 403 to the end 501 of the hook 103.

In this illustrative embodiment, the aperture 502 and the end 501 of the hook 103 are geometrically configured to prevent rotation of the key 403 about the end 501 of the hook. To wit, here the aperture 502 defines a flat side 505 and two arched protrusions 506,507. The end 501 of the hook 103 have a flat side 509 and two arched indentations 508 that are complementary in shape to the two arched protrusions 506,507. When the end 501 of the hook 103 opposite the extension (104) of the hanger 101 is inserted into an aperture 502 defined within a connector 504 of the key 403, engagement of the two arched protrusions 506,507 with the two arched indentations 508, opposite engagement of the flat side 505 of the aperture 502 with the flat side 508 of the end 501 of the hook 103 prevents rotation of the key 403 about the end 501 of the hook 103.

Figure 6:
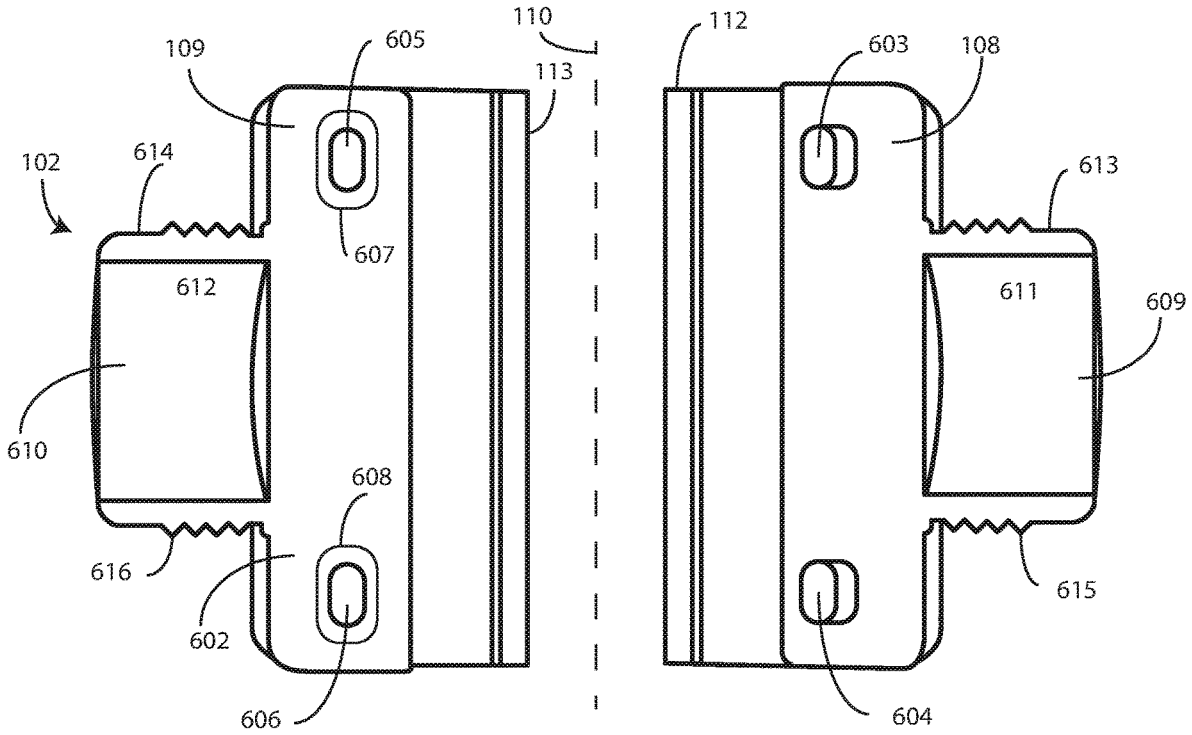
FIG. 6 illustrates one explanatory base member in accordance with one or more embodiments of the disclosure.

Turning now to FIG. 6, illustrated therein are the first base member portion 108 and the second base member portion 109 after having been separated along the medial major axis 110. This separation exposes the inner surfaces 601,602 of the first base member portion 108 and the second base member portion 109, respectively.

In one or more embodiments, the inner surface 601 of the first base member portion 108 comprises one or more bosses 603,604. Here, two bosses 603,604 are shown. However, more or fewer bosses can be included in other embodiments.

In this illustrative embodiment, the inner surface 602 of the second base member portion 109 comprises one or more boss receivers 605,606. Here, two boss receivers 605,606 are shown. However, more or fewer boss receivers can be included in other embodiments. In one or more embodiments, the boss receivers 605,606 comprise apertures that extend into the inner surface 602 of the second base member portion 109, and which have shapes that are complementary to the one or more bosses 603,604 of the inner surface 601 of the first base member portion 108. The one or more boss receivers 605 can optionally include wider mouths 607,608 at their openings to facilitate easier insertion of the one or more bosses 603,604 into the one or more boss receivers 605,606 when the first base member portion 108 and the second base member portion 109 are pressed together such that their inner surfaces 601,602 abut at the medial major axis 110.

In one or more embodiments, when the first base member portion 108 and the second base member portion 109 are pressed together such that their inner surfaces 601,602 abut at the medial major axis 110, the one or more bosses 603,604 insert into the one or more boss receivers 605,606. This prevents the inner surfaces 601,602 of the first base member portion 108 and the second base member portion 109 from sliding about.

In the illustrative embodiment of FIG. 6, the base member 102 includes a head receiver. As will be described in more detail below with reference to FIG. 7, the hanger (101) can also include a head. In this illustrative embodiment, the first base member portion 108 has a first half head receiver 609 extending distally from a side of the first base member portion 108 disposed opposite the first half rail clamp 112. Similarly, the second base member portion 109 has a second half head receiver 610 extending distally from a side of the second base member portion 109 disposed opposite the second half rail clamp 113.

In this illustrative embodiment, the first half head receiver 609 and the second half head receiver 610 are both hemicylindrical. When the first base member portion 108 and the second base member portion 109 are pressed together such that their inner surfaces 601,602 abut at the medial major axis 110, the edges of the first half head receiver 609 and the second half head receiver 610 also abut to define a cylindrical head receiver. While a cylinder is one suitable shape for a head receiver formed by abutment of the edges of the first half head receiver 609 and the second half head receiver 610, other shapes can be used as well. In other embodiments, the head receiver is rectangular, triangular, polygonal, or free form shapes. Still other shapes for the head receiver will be obvious to those of ordinary skill in the art having the benefit of this disclosure.

In one or more embodiments, the inner surfaces 611,612 of the first half head receiver 609 and the second half head receiver 610 define an interior socket to receive the head of a hanger (101) configured in accordance with one or more embodiments of the disclosure. In one or more embodiments, the exterior surfaces 613,614 of the first half head receiver 609 and the second half head receiver 610 define one or more threads 615,616. When the first base member portion 108 and the second base member portion 109 are pressed together such that their inner surfaces 601,602 abut at the medial major axis 110, the edges of the first half head receiver 609 and the second half head receiver 610 also abut to define a cylindrical head receiver having a an interior socket defined by the inner surfaces 611,612 of the first half head receiver 609 and the second half head receiver 610, and having threads defined by the exterior surfaces 613,614 of the first half head receiver 609 and the second half head receiver 610. The coupler (111) can then be threaded onto the threads defined by the exterior surfaces 613,614 of the first half head receiver 609 and the second half head receiver 610 to couple the first base member portion 108 and the second base member portion 109 together.

Figure 7:
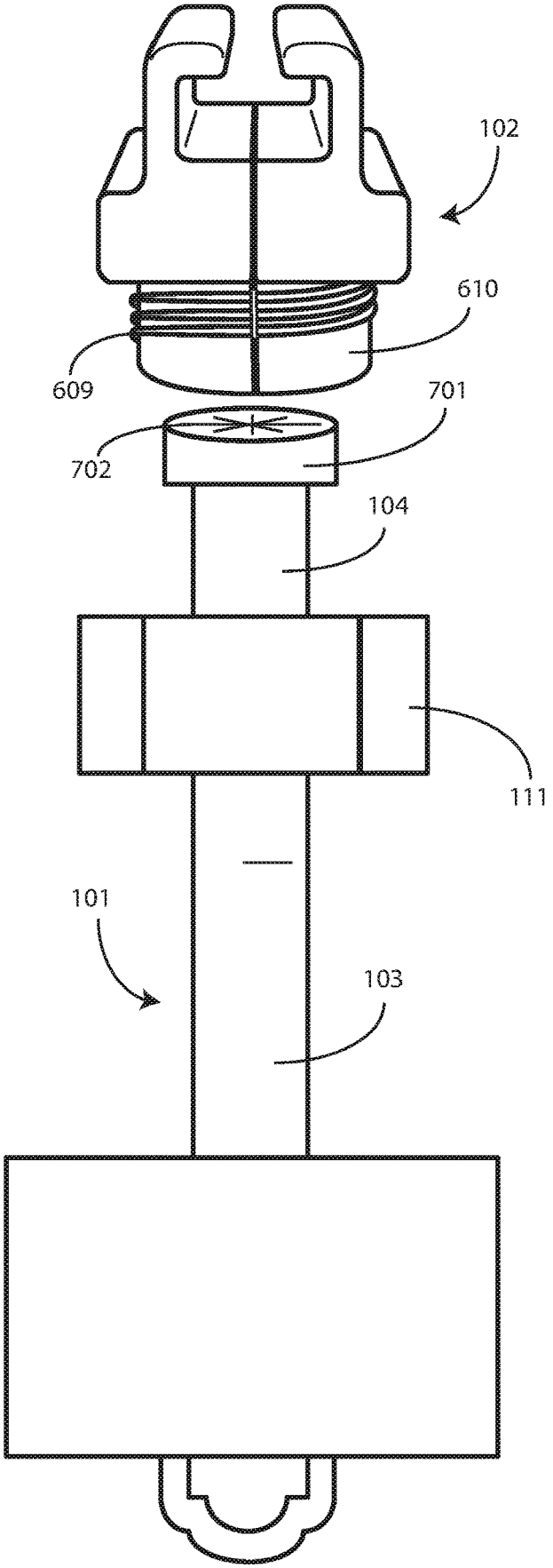
FIG. 7 illustrates one explanatory track hanger prior to assembly in accordance with one or more embodiments of the disclosure.

Turning now to FIG. 7, illustrated therein is the hanger 101 separated from the base member 102. As can be seen in this separated state, in one or more embodiments the hanger 101 includes a head 701, which is coupled to the extension 104. In this illustrative embodiment, the extension 104 is situated between the head 701 and the hook 103.

In this illustrative embodiment, the head 701 is cylindrical. While a cylinder is one suitable shape for the head 701, other shapes can be used as well. In other embodiments, the head 701 is rectangular, triangular, polygonal, or free form shapes. Still other shapes for the head 701 will be obvious to those of ordinary skill in the art having the benefit of this disclosure.

In one or more embodiments, the head 701 and the head receiver defined by the first half head receiver 609 and the second half head receiver 610 are complementary in shape. In this illustrative embodiment, the head 701 and the head receiver defined by the first half head receiver 609 and the second half head receiver 610, when abutting, are cylindrical.

The head receiver defined by the first half head receiver 609 and the second half head receiver 610, or more particularly, the interior socket defined by the inner surfaces (611,612) of the first half head receiver 609 and the second half head receiver 610, is configured to receive the head 701 when the head 701 is inserted into the head receiver defined by the first half head receiver 609 and the second half head receiver 610.

In one or more embodiments, the head 701 can include one or more teeth 702. Where included, the one or more teeth 702 can engage an interior surface of the interior socket defined by the inner surfaces (611,612) of the first half head receiver 609 and the second half head receiver 610, thereby preventing rotation of the head 701 when inserted into the head receiver defined by the first half head receiver 609 and the second half head receiver 610. In one or more embodiments, the interior surface of the interior socket defined by the inner surfaces (611,612) of the first half head receiver 609 and the second half head receiver 610 can include complementary teeth to engage the one or more teeth 702 of the head 701, thereby further preventing rotation of the head 701 when inserted into the head receiver defined by the first half head receiver 609 and the second half head receiver 610. Where rotation of the head 701 within head receiver defined by the first half head receiver 609 and the second half head receiver 610 is desired, the head 701 and the interior surface of the interior socket defined by the inner surfaces (611,612) of the first half head receiver 609 and the second half head receiver 610 can be smooth so as to facilitate movement. Lubricants can be placed between the head 701 and the interior surface of the interior socket defined by the inner surfaces (611,612) of the first half head receiver 609 and the second half head receiver 610 as well.

As shown in FIG. 7, prior to insertion of the head 701 into the interior socket defined by the inner surfaces (611,612) of the first half head receiver 609 and the second half head receiver 610, the coupler 111 is placed about the hanger 101. The head 701 is then inserted into the interior socket defined by the inner surfaces (611,612) of the first half head receiver 609 and the second half head receiver 610. This is shown in FIG. 8.

Figure 8:
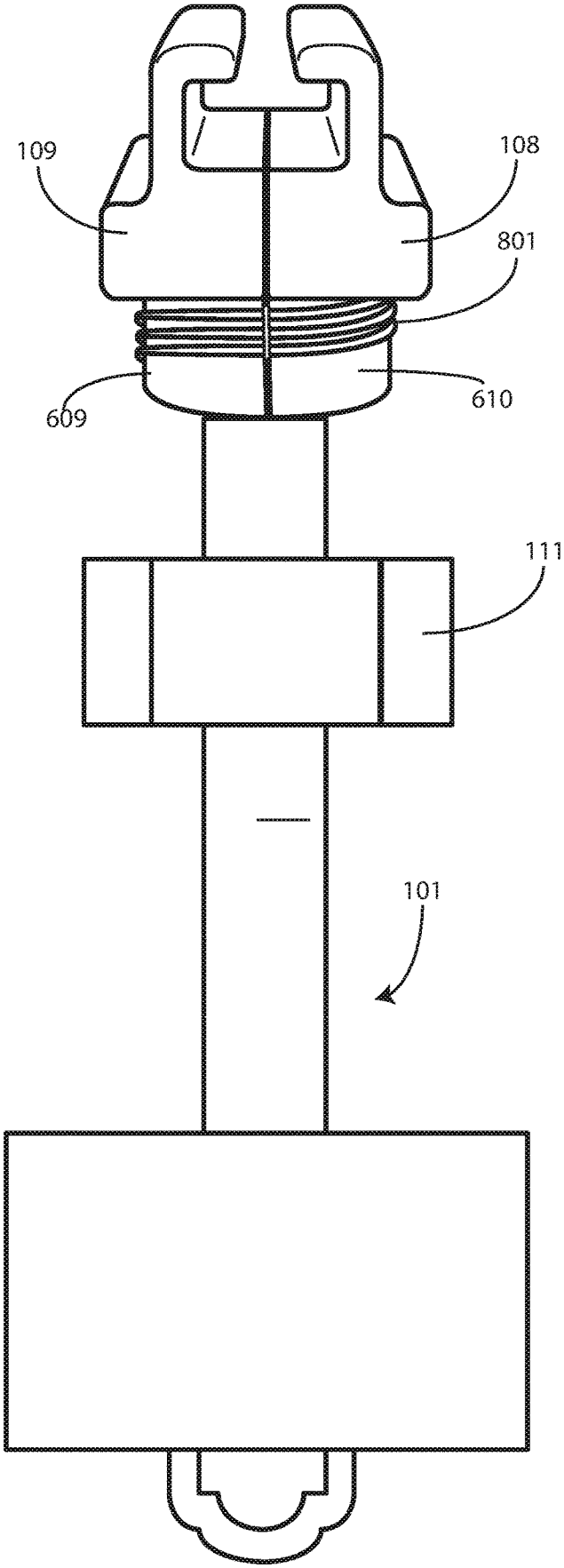
FIG. 8 illustrates a partially assembled track hanger in accordance with one or more embodiments of the disclosure.

Turning now to FIG. 8, once the head (701) is then inserted into the interior socket defined by the inner surfaces (611,612) of the first half head receiver 609 and the second half head receiver 610. The coupler 111, which includes interior threads, can then engage the one or more threads 801 disposed along the exterior surface of the head receiver defined by the first half head receiver 609 and the second half head receiver 610 to retain the first base member portion 108 and the second base member portion 109 together. This engagement of the coupler 111 to the one or more threads 801 disposed along the exterior surface of the head receiver defined by the first half head receiver 609 and the second half head receiver 610 also retains the head (701) of the hanger 101 within the interior socket defined by the inner surfaces (611,612) of the first half head receiver 609 and the second half head receiver 610. Said differently, in one or more embodiments, when the head (701) is inserted into the head receiver defined by the first half head receiver 609 and the second half head receiver 610, the coupler 111 is operable to engage the exterior surface of the head receiver defined by the first half head receiver 609 and the second half head receiver 610 to retain the head (701) within the head receiver defined by the first half head receiver 609 and the second half head receiver 610.

Figure 9:
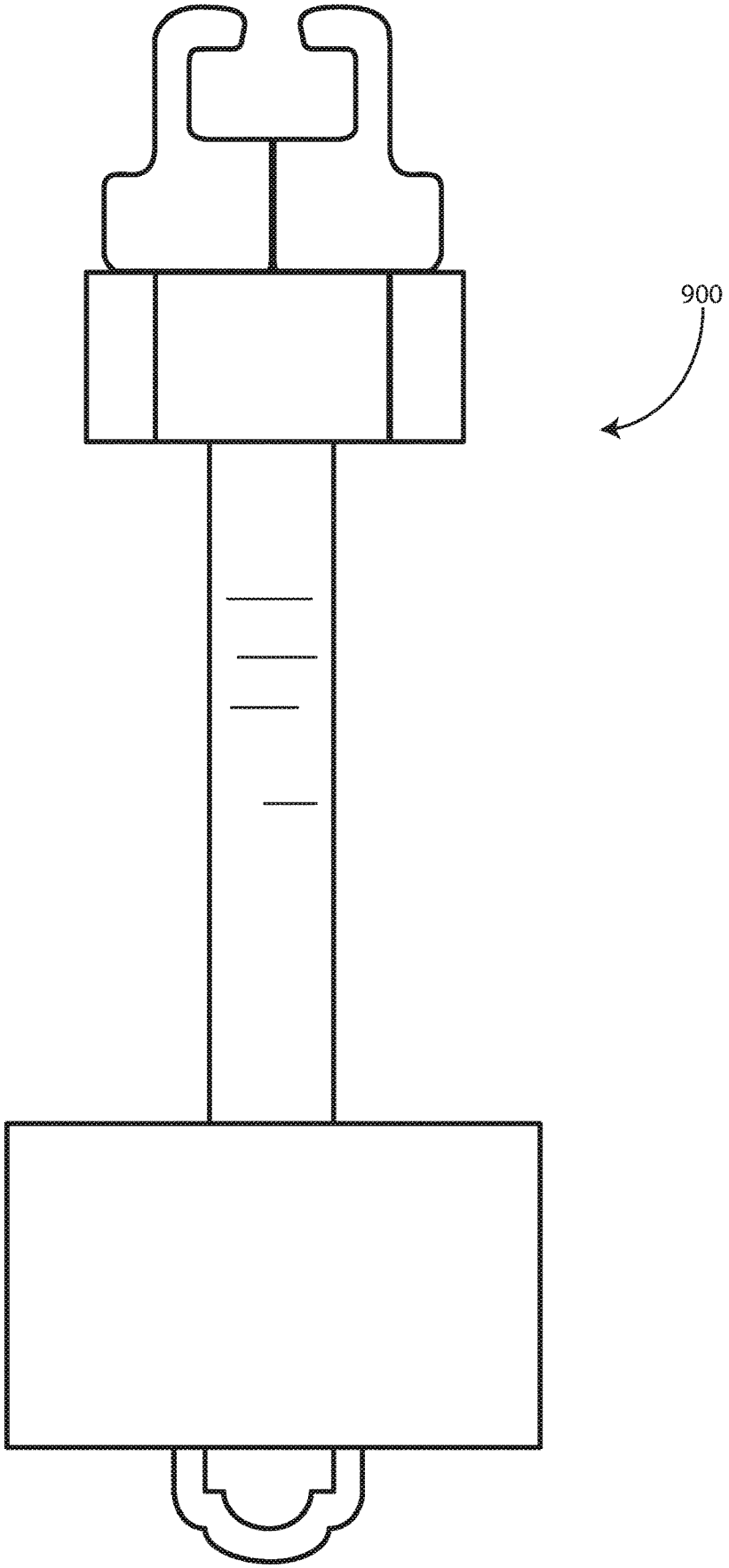
FIG. 9 illustrates an assembled track hanger in accordance with one or more embodiments of the disclosure.
Figure 10:
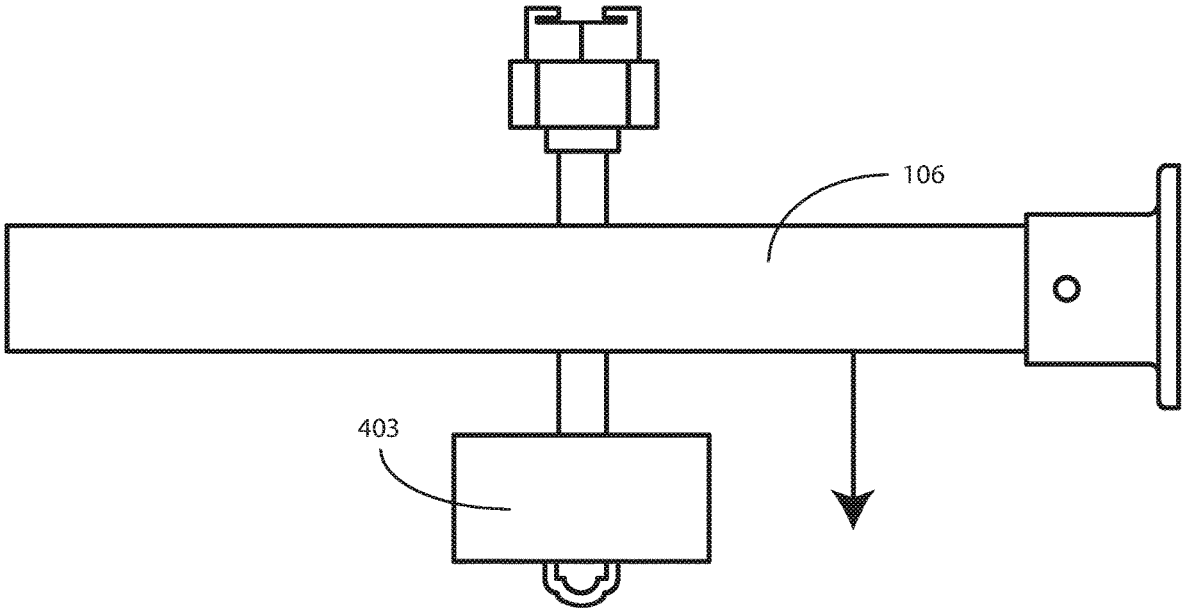
FIG. 10 illustrates a partially assembled track hanger system in accordance with one or more embodiments of the disclosure.

The completed hanger assembly 900 is shown in FIG. 9. As shown in FIG. 10, the track 106 can then be attached to the key 403 as described above with reference to FIG. 4, thereby yielding the embodiment shown in FIGS. 1-3.

Figure 11A:
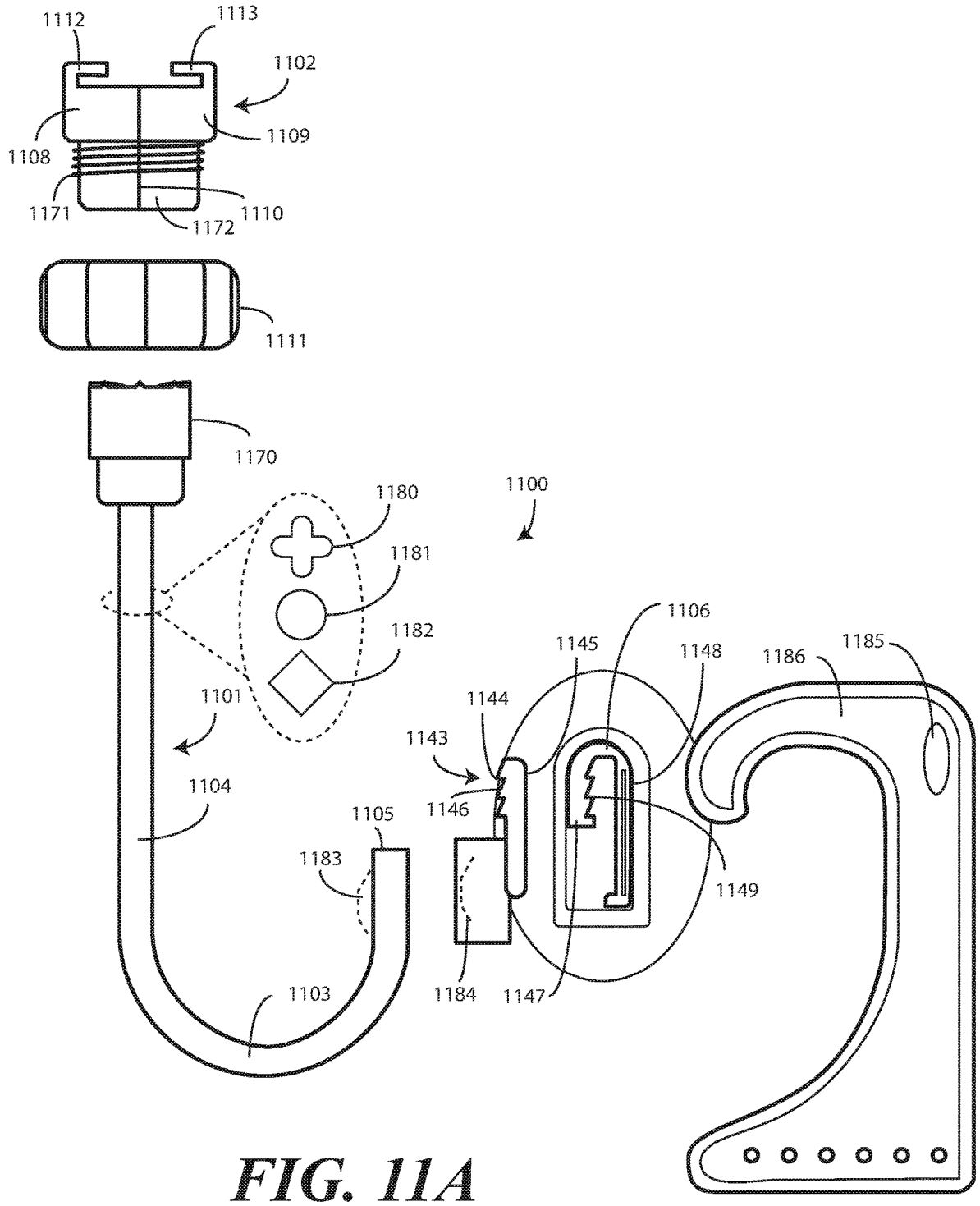
FIGS. 11A-C illustrates a perspective view of another explanatory track hanger system in accordance with one or more embodiments of the disclosure.
Figure 11B:
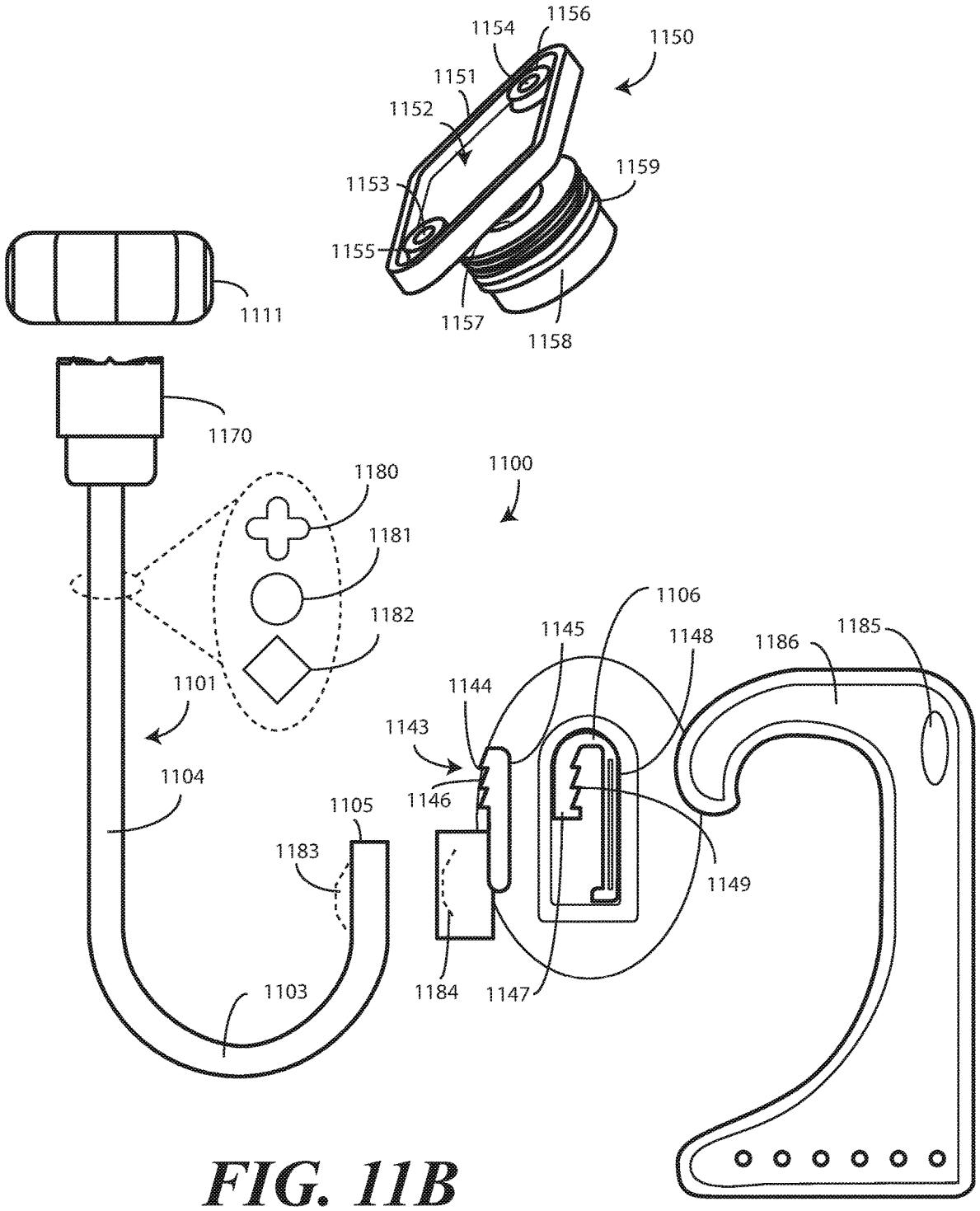
Figure 11C:
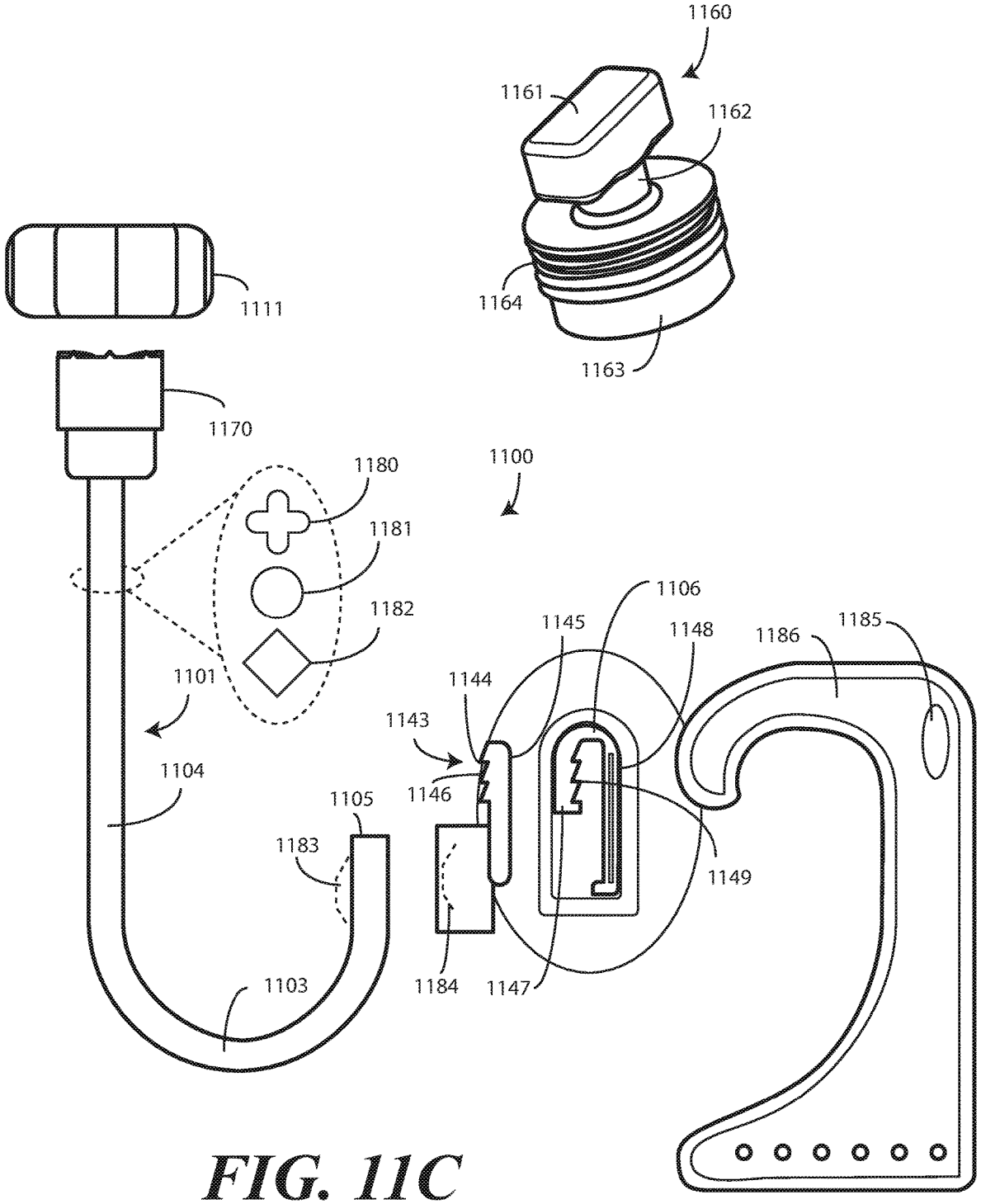

Turning now FIGS. 11A-C, illustrated therein are other explanatory embodiments of a track hanger 1100 configured in accordance with one or more embodiments of the disclosure. In one embodiment, the track hanger 1100 is to suspend a track from a surface such as a wall or ceiling.

The track hanger 1100, in one or more embodiments, includes a hanger 1101, a base member 1102, and a key 1143. In this illustrative embodiment, the hanger 1101 has a circular cross section 1181. However, the hanger 1101 can have other cross sections as well. For example, in another embodiment the hanger 1101 has a cross section 1180 configured as a cross or an "X." In still another embodiment, the hanger 1101 has a cross section 1182 that is a square or diamond. Other cross sections, such as ovals, free form shapes, polygons, and the like, will be obvious to those of ordinary skill in the art having the benefit of this disclosure.

In one or more embodiments, each of the hanger 1101, the base member 1102, and the key 1143 are separable from each other. For example, in one embodiment the hanger 1101 can be detached from the base member 1102. Similarly, the key 1143 can be detached from the hanger 1101. However, in other embodiments, one or more of the hanger 1101, base member 1102, or the key 1143 can be integrated with, or perdurably connected to, another of the hanger 1101, base member 1102, or the key 1143. Illustrating by example, in one or more embodiments the base member 1102 and the hanger 1101 can be constructed as a single, integrated, unitary component. In one embodiment, base member 1102 and hanger 1101 are constructed as a single, integrated, unitary component. Similarly, base member 1150 and hanger 1101 can be constructed as a single, integrated, unitary component. Moreover, base member 1160 and hanger 1101 can be constructed as a single, integrated, unitary component, and so forth.

In these illustrations, three different and interchangable base members 1102,1150,1160 are shown. The first base member 1102 shown in FIG. 11A is a track clip base member, while the second base member 1150 shown in FIG. 11B is a screw adaptor base member. The third base member 1106 shown in FIG. 11C is a track insertion base member. The first base member 1102 is similar to that shown above with reference to FIGS. 1-4.

The second base member 1150 includes a quadrilateral attachment support 1151 that defines a recess 1152 along its upper surface. Two apertures 1153,1154, through which screws can be inserted from the lower surface of the quadrilateral attachment support 1151, through the apertures 1153,1154, and out the upper surface of the quadrilateral attachment support 1151 to attach the second base member 1150 to a ceiling. Each aperture 1153,1154 is surrounded by a boss 1155,1156 in the recess 1152. The recess 1152 is bounded by a perimeter wall as shown in this illustrative embodiment. A head receiver 1158 includes one or more threads 1159 as previously described. A neck 1157, which has a diameter that is smaller than that of the head receiver 1158, and is also narrower than a minor dimension of the quadrilateral of the quadrilateral attachment support 1151, separates the quadrilateral attachment support 1151 and the head receiver 1158.

The third base member 1160 includes a rectangular track insertion head 1161 that can be inserted into a track with the major axis of the rectangular track insertion head 1161 parallel to the major axis of the track. A head receiver 1163 includes one or more threads 1164 as previously described. A neck 1162, which has a diameter that is smaller than that of the head receiver 1163, and is also narrower than a minor dimension of the rectangular track insertion head 1161, separates the rectangular track insertion head 1161 and the head receiver 1163.

In one or more embodiments, the hanger 1101 comprises a hook 1103 and an extension 1104. In one or more embodiments, the key 1143 attaches to a distal end 1105 of the hook 1103. Accordingly, where the key 1143 is detachable from the hanger 1101, the attachment location to attach or detach the key 1143 from the hook 1103 is the distal end 1105. Thus, in one or more embodiments the key 1143 is detachable from the hook 1103.

In one embodiment, the distal end 1105 of the hook 1103 simply inserts into the key 1143, with a friction fit holding the two components together. In another embodiment, a protrusion 1183 disposed along the distal end 1105 of the hook 1103 inserts into a recess 1184 configured in the key 1143 for a snap fit. Other engagements for the distal end 1105 of the hook 1103 and the key 1143 will be obvious to those of ordinary skill in the art having the benefit of this disclosure.

In one embodiment, the hanger 1101 is configured as a single, unitary element. Said differently, in one embodiment the hook 1103 and the extension 1104 are manufactured as a single, integral unit. In this illustrative embodiment, the hanger 1101 also includes a head 1170. Where included, the hook 1103, the extension 1104, and the head 1170 can be manufactured as a single, integral unit as previously described.

In one embodiment the key 1143 includes a first major surface 1144 and a second major surface 1145. In this illustrative embodiment, the first major surface 1144 defines one or more barbs 1146. Each barb comprises a hemi-triangular protrusion with the base of each hemi-triangular protrusion being disposed beneath the side of the hemi-triangular protrusion. In this illustrative embodiment, the second major surface 1145 is substantially planar.

In one or more embodiments, a track 1106 attaches to the key 1143. In this illustrative embodiment, the track 1106 has a first flat side 1147 and a second flat side 1148. An arch spans between ends of the first flat side 1147 and the second flat side 1148 in this embodiment. In one embodiment, the track 1106 is flexible so that it can be shaped into different contours when attached to a track hanger 1100.

In one embodiment, the track 1106 is a continuous piece. In other embodiments, segments of different tracks can be aligned end-to-end to form a composite track. In one embodiment, the track 1106 is malleable. While the cross section of the track 1106 shown in FIG. 10 is generally flat along each of the first flat side 1147 and the second flat side 1148, it should be noted that the cross section could take other shapes as well, such as ovular or flat.

In one embodiment the track 1106 is configured so as to be easily cleanable. In one embodiment, the track 1106 is manufactured so as to be light beige in color. In one embodiment, the track 1106 is cut to predefined lengths, such as twenty-foot lengths. In one or more embodiments, the ends of the track 1106 can be contoured for smooth interconnection to adjacent track segments.

The inclusion of the first flat side 1147, the second flat side 1148, and the arch define a peninsular indentation into which the key 1143 may be inserted. In this illustrative embodiment, the track 1106 comprises one or more complementary barbs 1149. Each of the one or more complementary barbs 1149 is complementary in shape to the one or more barbs 1146 of the key 1143. Here, each complementary barb comprises an inverted hemi-triangular protrusion with a base of each inverted hemi-triangular protrusion being disposed above a side of the inverted hemi-triangular protrusion.

Using this configuration, the one or more barbs 1146 of the key 1143 facilitate one-way penetration of the key 1143 into the track 1106. In one or more embodiments, the track 1106 is manufactured from a pliable material, such as a thermoplastic. When the key 1143 is inserted into the peninsular indentation, the first flat side 1147 of the track 1106 flexes so that the one or more complementary barbs 1149 of the track 1106 pass over the one or more barbs 1146 of the key 1143. Once the key 1143 is fully inserted into the peninsular indentation of the track 1106, first flat side 1147 of the track 1106 flex back toward the key 1143, thereby causing the one or more complementary barbs 1149 to engage the one or more barbs 1146 of the key 1143. This results in the key 1143 being frictionally retained within the track 1106.

In one or more embodiments, the second flat side 1148 of the track 1106 terminates at an end opposite the arch in an L-shaped latch. In one or more embodiments, the second major surface 1145 of the key includes a complementary L-shaped indention into which the base of the "L" of the L-shaped latch seats when the key 1143 is fully inserted into the track 1106.

In operation, when the key 1143 is inserted into the peninsular indentation, the second flat side 1148 of the track 1106 flexes so the base of the "L" of the L-shaped latch of the track 1106 can pass over the second flat side 1148 of the key 1143. Once the key 1143 is fully inserted into the peninsular indentation of the track 1106, second flat side 1148 of the track 1106 flexes back toward the key 1143, thereby causing the base of the "L" of the L-shaped latch to seat within the complementary L-shaped indention of the key 1143. This assists in retaining the key 1143 within the track 1106.

In one or more embodiments, the base member 1102 comprises a first base member portion 1108 and a second base member portion 1109. In one or more embodiments, the first base member portion 1108 and the second base member portion 1109 are separable along a medial major axis 1110. In the illustrative embodiment of FIGS. 11A-C, the first base member portion 1108 and the second base member portion 1109 have been placed together such that their inner surfaces abut along the medial major axis 1110. A coupler 1111, which in this embodiment is a plastic hex nut, couples the first base member portion 1108 and the second base member portion 1090 together to retain the inner surfaces abutting at the medial major axis 1110.

In one or more embodiments, the first base member portion 1108 defines a first half rail clamp 1112. Similarly, the second base member portion 1109 defines a second half rail clamp 1113. Each of the first half rail clamp 1112 and the second half rail clamp 1113 includes a vertical member extending distally from the first base member portion 1108 and the second base member portion 1109, respectively, and a horizontal member extending distally from its respective vertical member only a portion of the width of the first base member portion 1108 and the second base member portion 1109. This leaves a gap between each horizontal member, as shown.

Separating the first base member portion 1108 from the second base member portion 1109 along the medial major axis 1110 therefore separates the first half rail clamp 1112 from the second half rail clamp 1113. When used with a drop ceiling having a suspension grid of tracks, one can simply place the first half rail clamp 1112 to the left of a track and the second half rail clamp 1113 to the right of the track, or vice versa. The first base member portion 1108 can then be pressed against the second base member portion 1109 along the medial major axis 1110. This causes the track of the suspension grid to be caught between the first half rail clamp 1112 and the second half rail clamp 1113.

When the coupler 1111 is then be attached to the base member 1102 to retain the first base member portion 1108 against the second base member portion 1109, this causes the first half rail clamp 1112 from the second half rail clamp 1113 to couple the track hanger 1100 to the rail of the suspension grid. In one or more embodiments, the coupler 1111 engages one or more threads 1171 disposed on the exterior surface of a head receiver 1172 extending distally from the base member 1102 to retain the first base member portion 1108 against the second base member portion 109. The coupler 1111 can also be used to retain a head 1170, which is attached to the extension 1104 and hook 1103, within an interior socket supporting the threads. Thus, in one or more embodiments, the track hanger 1100 comprises a uniquely configured base member 1102 that facilitates simple mounting and dismounting of the track hanger 1100 to a track of a conventional suspension grid of a drop ceiling. The hanger 1186 can optionally include an aperture 1185 in its top corner. The track hanger 1100 can be assembled as previously described above with reference to FIGS. 7-9.

Figure 12:
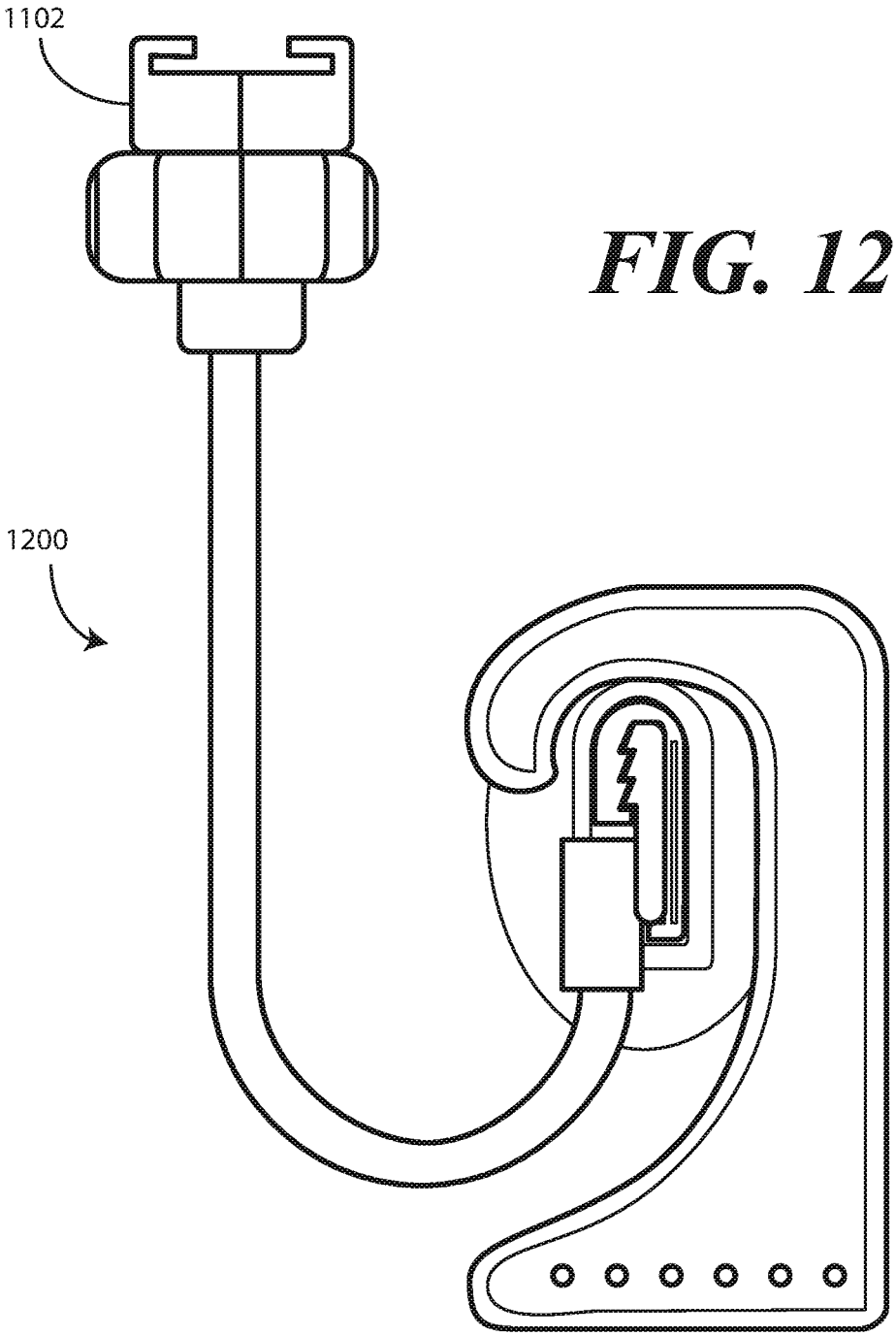
FIG. 12 illustrates another assembled track hanger in accordance with one or more embodiments of the disclosure.
Figure 13:
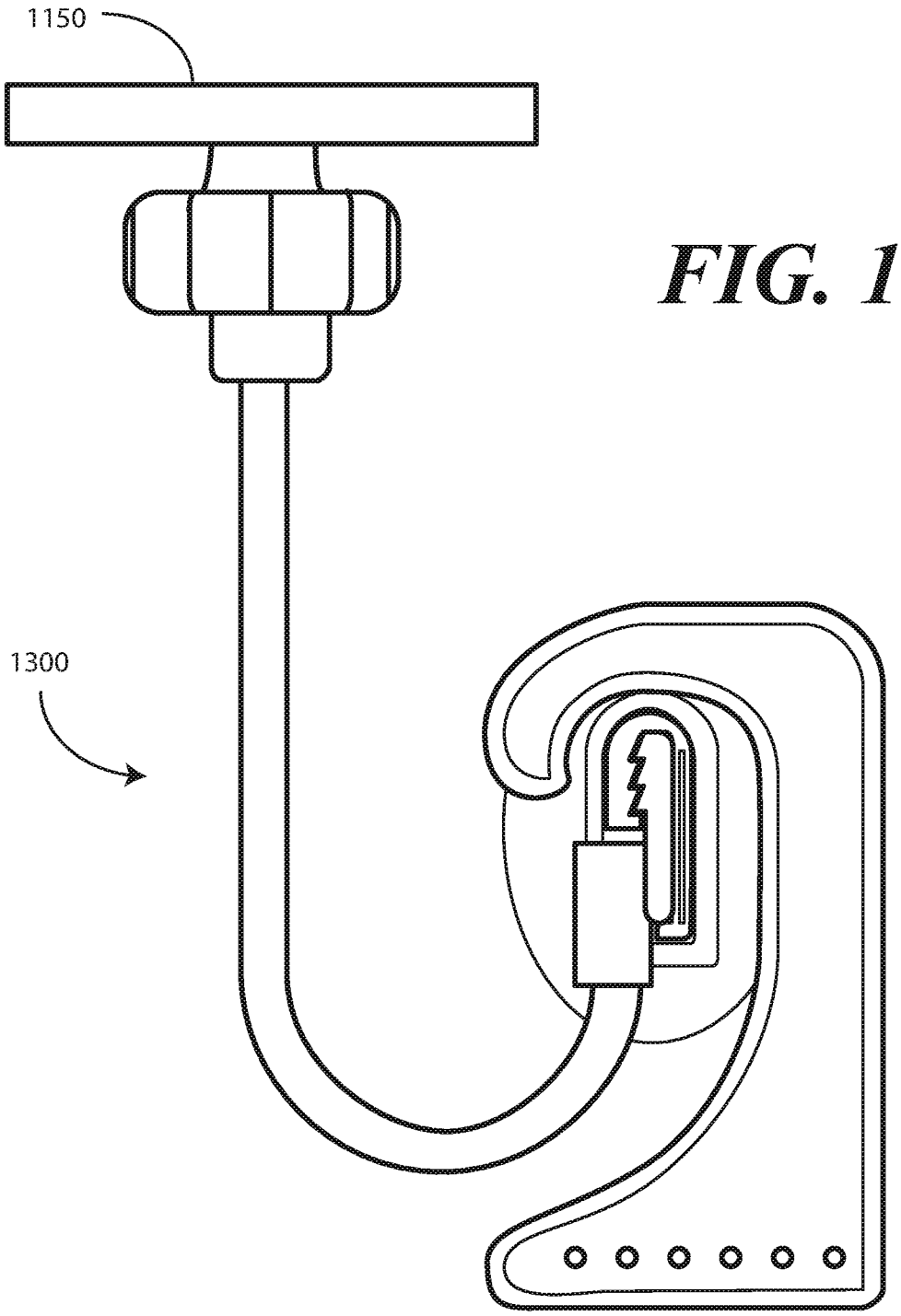
FIG. 13 illustrates another assembled track hanger in accordance with one or more embodiments of the disclosure.
Figure 14:
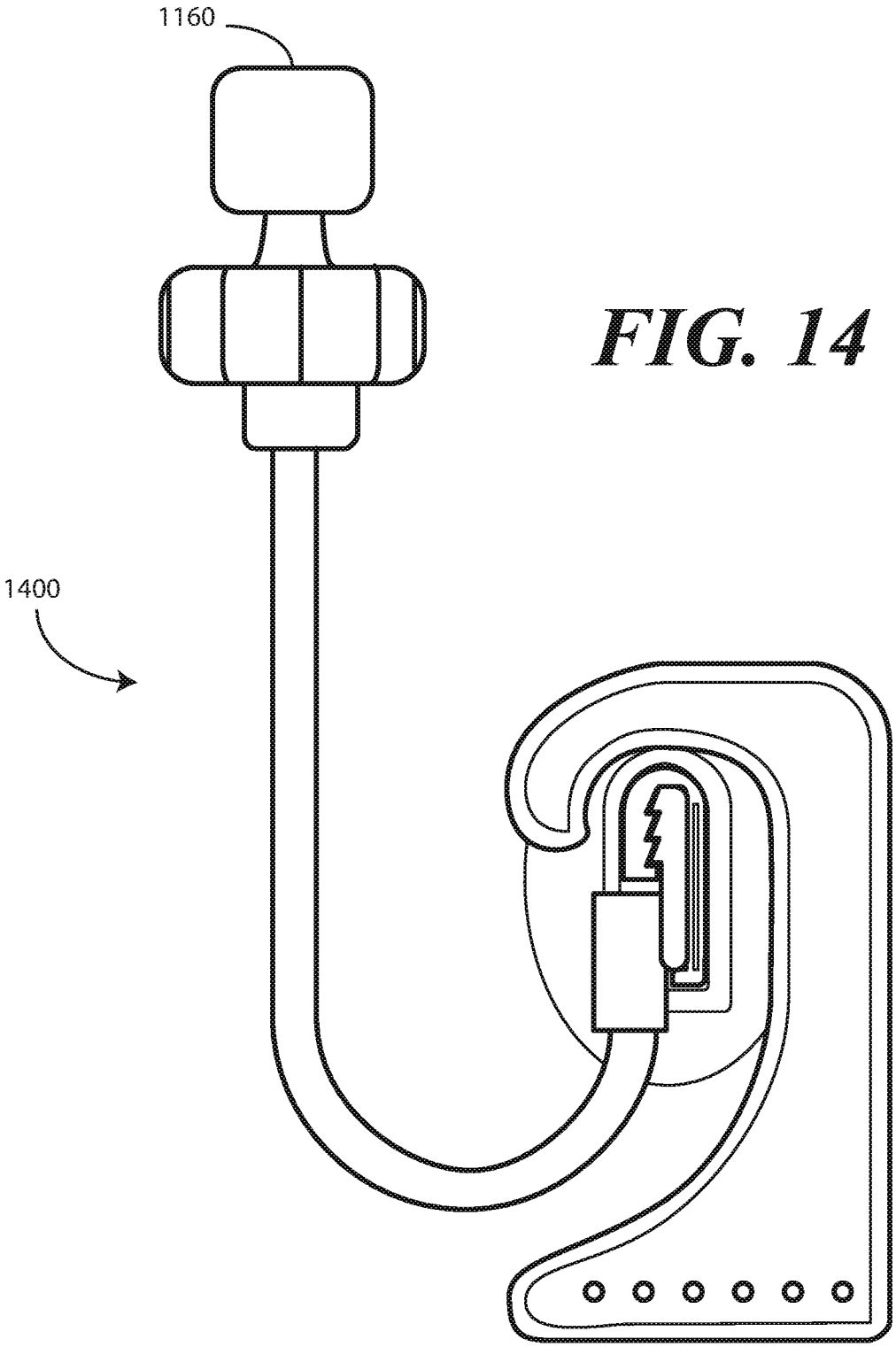
FIG. 14 illustrates yet another assembled track hanger in accordance with one or more embodiments of the disclosure.

The completed hanger assembly 1200 using the first base member 1102 is shown in FIG. 12. The completed hanger assembly 1300 using the second base member 1150 is shown in FIG. 13. The completed hanger assembly 1400 using the first base member 1160 is shown in FIG. 14.

In the foregoing specification, specific embodiments of the present disclosure have been described. However, one of ordinary skill in the art appreciates that various modifications and changes can be made without departing from the scope of the present disclosure as set forth in the claims below. Thus, while preferred embodiments of the disclosure have been illustrated and described, it is clear that the disclosure is not so limited. Numerous modifications, changes, variations, substitutions, and equivalents will occur to those skilled in the art without departing from the spirit and scope of the present disclosure as defined by the following claims. Accordingly, the specification and figures are to be regarded in an illustrative rather than a restrictive sense, and all such modifications are intended to be included within the scope of present disclosure. The benefits, advantages, solutions to problems, and any element(s) that may cause any benefit, advantage, or solution to occur or become more pronounced are not to be construed as a critical, required, or essential features or elements of any or all the claims.

What is claimed is:

1. A track hanger, comprising:
a hook and an extension;
a base member; and
a key;
wherein the key is detachable from the hook;
wherein the base member is detachable from the extension; and
wherein the key comprises a first major surface and a second major surface, the first major surface defining one or more barbs;
further comprising a head, wherein the extension is situated between the head and the hook;
the base member comprising a head receiver comprising an interior socket and an exterior surface, the interior socket receiving the head when the head is inserted into the head receiver;
the base member comprising a track insertion head and a neck extending between the track insertion head and the head receiver;
wherein the neck of the base member has a diameter smaller than that of the head receiver.

2. The track hanger of claim 1, wherein the hook, the head, and the extension define a singular, unitary component.

3. The track hanger of claim 1, wherein both the head and the head receiver are cylindrical.

4. The track hanger of claim 3, an end of the head defining one or more teeth preventing rotation of the head in the interior socket when the head is inserted into the head receiver.

5. The track hanger of claim 1, the exterior surface defining one or more threads.

6. The track hanger of claim 1, wherein the track insertion head is substantially rectangular.

7. The track hanger of claim 6, wherein the track insertion head is configured for insertion into a track with the length of the track insertion head oriented parallel to a major axis of the track.

8. The track hanger of claim 5, further comprising a coupler engaging the one or more threads on the exterior surface of the head receiver to retain the head within the interior socket.

9. The track hanger of claim 1, wherein the track insertion head comprises at least one chamfer between major faces of the track insertion head.

10. The track hanger of claim 9, further comprising a track, the one or more barbs facilitating one-way penetration of the key into the track.

11. The track hanger of claim 10, wherein the second major surface is substantially planar.

12. A track hanger, comprising:

a hook, a head, and an extension, the extension disposed between the head and the hook;

a base member defining a head receiver;

a key, the key being selectively attachable to the hook; and a coupler;

wherein the head is insertable into the head receiver and the coupler is operable to engage an exterior surface of the head receiver to retain the head within the head receivers;

the base member comprising a track insertion head and a neck extending between the track insertion head and the head receiver;

wherein the neck of the base member has a diameter smaller than that of the head receiver.

13. The track hanger of claim 12, wherein the key comprises a first major surface and a second major surface, the first major surface defining one or more barbs.

14. The track hanger of claim 13, the base member comprising a substantially rectangular track insertion head.

15. The track hanger of claim 13, further comprising a track, the one or more barbs facilitating one-way penetration of the key into the track.

* * * * *